US011585121B2

(12) United States Patent
Jaskiewicz et al.

(10) Patent No.: US 11,585,121 B2
(45) Date of Patent: Feb. 21, 2023

(54) RESIDENTIAL ENTRYWAY DOOR WITH CONCEALED MULTIPOINT LOCK

(71) Applicant: Endura Products, LLC, Colfax, NC (US)

(72) Inventors: Tomasz Jaskiewicz, Oak Ridge, NC (US); Adam Kendall, Burlington, NC (US)

(73) Assignee: Endura Products, LLC, Colfax, NC (US)

( * ) Notice: Subject to any disclaimer, the term of this patent is extended or adjusted under 35 U.S.C. 154(b) by 1165 days.

(21) Appl. No.: 16/160,424

(22) Filed: Oct. 15, 2018

(65) Prior Publication Data

US 2019/0119952 A1 Apr. 25, 2019

Related U.S. Application Data

(60) Provisional application No. 62/576,958, filed on Oct. 25, 2017.

(51) Int. Cl.
*E05B 65/06* (2006.01)
*E05B 61/00* (2006.01)
(Continued)

(52) U.S. Cl.
CPC ..... *E05B 65/06* (2013.01); *E05B 61/00* (2013.01); *E05C 1/002* (2013.01); *E05C 1/004* (2013.01);
(Continued)

(58) Field of Classification Search
CPC ..... E05B 65/06; E05B 61/00; E05B 17/0075; E05C 1/02; E05C 1/004; E05C 9/004; E05C 9/085; E05C 9/02; E05C 9/185; E05C 9/04; E05C 9/22; E05C 7/04; E05C 7/045; E05C 9/026; E05C 1/002; E06B 3/70;
(Continued)

(56) References Cited

U.S. PATENT DOCUMENTS 1,621,740 A * 3/1927 Pavola ..... E06B 7/18 49/319
3,606,775 A * 9/1971 Atkins ..... E05C 1/04 70/129
(Continued)

FOREIGN PATENT DOCUMENTS

CA 3021796 3/2021

OTHER PUBLICATIONS

Canadian Office Action for Application No. 3021796, dated Oct. 10, 2019, 4 pgs.
(Continued)

*Primary Examiner* — Christine M Mills
*Assistant Examiner* — Faria F Ahmad
(74) *Attorney, Agent, or Firm* — Womble Bond Dickinson (US) LLP

(57) ABSTRACT

A door panel for use in a residential entryway includes a frame having a first stile, a second stile, a top rail connecting the first stile to the second stile, and a bottom rail connecting the first stile to the second stile. The door panel also includes a pair of opposing skins on respective faces of the frame. The first stile includes a channel along a length thereof on an interior longitudinal surface of the first stile. A cover is attached to the interior longitudinal surface of the first stile to at least partially seal the channel

15 Claims, 7 Drawing Sheets

(51) Int. Cl.

| | |
|---|---|
| ***E05C 9/00*** | (2006.01) |
| ***E05C 1/00*** | (2006.01) |
| ***E05C 9/08*** | (2006.01) |
| ***E05C 9/02*** | (2006.01) |
| ***E05C 9/18*** | (2006.01) |
| ***E06B 3/70*** | (2006.01) |
| ***E05B 17/00*** | (2006.01) |
| ***E06B 3/72*** | (2006.01) |
| ***E05C 7/04*** | (2006.01) |
| ***E05C 9/04*** | (2006.01) |
| ***E05C 9/22*** | (2006.01) |

(52) U.S. Cl.
CPC ..... *E05C 9/004* (2013.01); *E05C 9/02* (2013.01); *E05C 9/085* (2013.01); *E05C 9/185* (2013.01); *E05B 17/0075* (2013.01); *E05C 7/045* (2013.01); *E05C 9/04* (2013.01); *E05C 9/22* (2013.01); *E06B 2003/7046* (2013.01); *Y10S 292/21* (2013.01); *Y10T 292/0834* (2015.04)

(58) Field of Classification Search
CPC ..... E06B 3/72; E06B 2003/7046; E06B 7/28; E06B 3/721; E06B 3/723; E06B 3/725; E06B 3/726; E06B 3/728; E06B 5/00; E06B 5/003; E06B 5/006; E06B 2003/7049; Y10T 292/102; Y10T 292/0836; Y10T 292/0838; Y10T 70/523; Y10T 292/0834; Y10T 292/0802; Y10S 292/21
See application file for complete search history.

(56) References Cited

U.S. PATENT DOCUMENTS

| | | | | | |
|---|---|---|---|---|---|
| 3,617,080 | A * | 11/1971 | Miller | E05C 9/045 | 292/38 |
| 3,895,669 | A * | 7/1975 | Heeling | E06B 5/003 | 160/180 |
| 3,910,612 | A * | 10/1975 | Guiraud | E05B 15/024 | 292/33 |
| 4,339,487 | A * | 7/1982 | Mullet | B29C 44/326 | 428/71 |
| 4,643,005 | A * | 2/1987 | Logas | E05C 9/026 | 70/95 |
| 4,779,325 | A * | 10/1988 | Mullet | E06B 3/485 | 29/460 |
| 5,120,094 | A * | 6/1992 | Eaton | E05B 65/087 | 292/159 |
| 5,139,291 | A * | 8/1992 | Schultz | E05C 1/10 | 292/337 |
| 5,328,217 | A * | 7/1994 | Sanders | E05B 15/0245 | 292/341.19 |
| 5,373,716 | A * | 12/1994 | MacNeil | E05C 9/1808 | 70/489 |
| 5,435,108 | A * | 7/1995 | Overholt | E04C 2/292 | 160/236 |
| 5,542,720 | A * | 8/1996 | Fleming | E05B 63/20 | 292/32 |
| 5,575,321 | A * | 11/1996 | Currier | E06B 9/52 | 49/404 |
| 5,660,420 | A * | 8/1997 | Smith | E05C 9/20 | 292/DIG. 60 |
| 5,878,606 | A * | 3/1999 | Chaput | E05B 63/185 | 70/108 |
| 6,217,087 | B1 * | 4/2001 | Fuller | E05B 55/00 | 292/33 |
| 6,457,751 | B1 * | 10/2002 | Hartman | E05B 17/2053 | 292/137 |
| 6,637,784 | B1 * | 10/2003 | Hauber | E05B 63/242 | 292/300 |
| 6,688,656 | B1 * | 2/2004 | Becken | E05B 65/0858 | 292/26 |
| 6,905,152 | B1 * | 6/2005 | Hudson | E05C 1/065 | 292/143 |
| 6,971,686 | B2 * | 12/2005 | Becken | E05B 63/20 | 292/142 |
| 7,036,854 | B1 * | 5/2006 | Lai | E05C 1/065 | 292/141 |
| 7,353,637 | B2 * | 4/2008 | Harger | E05B 15/0086 | 292/302 |
| 7,513,539 | B2 * | 4/2009 | Phipps | E05B 17/2053 | 292/143 |
| 7,513,540 | B2 * | 4/2009 | Hagemeyer | E05B 15/0205 | 292/156 |
| 7,543,860 | B2 * | 6/2009 | Meeks | E05C 1/04 | 292/137 |
| 7,752,809 | B2 * | 7/2010 | Di Vinadio | E05C 9/006 | 49/192 |
| 7,832,166 | B2 * | 11/2010 | Daniels | E06B 5/161 | 52/455 |
| 8,061,166 | B2 * | 11/2011 | Tsai | E05C 9/026 | 70/107 |
| 8,182,002 | B2 * | 5/2012 | Fleming | E05B 15/004 | 292/40 |
| 8,881,494 | B2 * | 11/2014 | Daniels | E04B 1/80 | 52/784.11 |
| 8,984,821 | B2 * | 3/2015 | Bruno | E06B 3/72 | 52/286 |
| 9,051,763 | B2 * | 6/2015 | Taylor | E05C 9/22 | |
| 9,243,444 | B2 * | 1/2016 | Daniels | E06B 5/16 | |
| 9,375,899 | B2 * | 6/2016 | Daniels | B32B 13/04 | |
| 9,388,611 | B2 * | 7/2016 | Schuberth | E05B 9/08 | |
| 9,506,278 | B2 | 11/2016 | Mattrisch | | |
| 9,624,701 | B2 * | 4/2017 | Taylor | E05C 9/04 | |
| 10,876,324 | B2 * | 12/2020 | Jaskiewicz | E05C 9/026 | |
| 2007/0029812 | A1 * | 2/2007 | Monts de Oca | E05C 1/06 | 292/137 |
| 2007/0084258 | A1 * | 4/2007 | Matyko | E05C 9/047 | 70/120 |
| 2008/0087052 | A1 * | 4/2008 | Abdollahzadeh | E05C 9/1883 | 70/93 |
| 2009/0019779 | A1 * | 1/2009 | Nakanishi | E05B 63/185 | 49/449 |
| 2011/0018285 | A1 * | 1/2011 | Mitchell | E05C 9/1891 | 292/161 |
| 2012/0049540 | A1 | 3/2012 | Taylor et al. | | |
| 2012/0049541 | A1 * | 3/2012 | Taylor | E05C 9/22 | 292/157 |
| 2012/0248789 | A1 * | 10/2012 | Mattrisch | E05C 9/20 | 292/33 |
| 2013/0026768 | A1 * | 1/2013 | Nolte | E05C 7/04 | 292/42 |

OTHER PUBLICATIONS

Canadian Notice of Allowance for Application No. 3021796, dated Sep. 29, 2020, 1 pg.

* cited by examiner

RESIDENTIAL ENTRYWAY DOOR WITH CONCEALED MULTIPOINT LOCK

FIELD OF THE DISCLOSURE

The present disclosure relates to door panels with multipoint locks as well as methods of making the same.

BACKGROUND

Homeowners and builders are increasingly turning to multipoint locks as alternatives to conventional cylindrical locks because multipoint locks provide an increased combination of security and weather sealing. Multipoint locks are often able to align a door panel with an adjacent panel, or the door frame, in a more precise manner than locks with a single latch point or pair of closely spaced latch points. Component alignment, in turn, improves the available seal around the door to keep out moisture and air.

Inclusion of a multipoint lock typically requires the free edge of the door panel to be machined along part or all of its length to allow for insertion of the typical components of a multipoint lock, which include a mortise box, drive rods, and auxiliary latches. Once the lock is inserted into the door panel a decorative trim is applied to the free edge of the door to cover the multipoint lock, and at times hold it in place. The decorative trim would span the length from the mortise box to at least the auxiliary latches.

In some instances, especially when the auxiliary latches are shoot bolts configured to extend from the top and bottom of the door panel, a hole is sometimes drilled into the door panel from the top and bottom edge thereof. The holes allow for passage of the drive rods to connect the mortise box to the auxiliary latches. The use of holes machined into the door panel from the top and bottom edges has the benefit of helping to conceal some or all of the presence of a multipoint lock when viewing the free edge of the door. The process of machining the holes, however, can be inefficient, and maintaining alignment while machining the holes can be difficult.

SUMMARY

One embodiment of the present disclosure includes a door panel for use in a residential entryway. The door panel includes a frame having a first stile, a second stile, a top rail connecting the first stile to the second stile, and a bottom rail connecting the first stile to the second stile. The door panel also includes a pair of opposing skins on respective faces of the frame. The first stile includes a channel along a length thereof on an interior longitudinal surface of the first stile. A cover is attached to the interior longitudinal surface of the first stile to at least partially seal the channel with respect to an insulating material provided within an interior of the door panel.

Another embodiment of the present disclosure includes a method of forming a door panel having a multipoint lock. The method comprises acquiring a first stile, a second stile, a top rail, and a bottom rail suitable for forming a frame of the door panel. The method further comprises creating a channel along a longitudinal surface of the first stile and arranging the longitudinal surface of the first stile to face the second stile. The method also includes at least partially positioning the multipoint lock within the channel and attaching a cover to the longitudinal surface to seal at least a portion of the channel The method also includes joining the first stile, the second stile, the top rail, and the bottom rail to form the frame, joining a pair of skins to the frame, and at least partially filling an interior of the frame with an insulating material after the skins are joined to the frame. The cover substantially prevents the insulating material from entering the channel.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Embodiments of the present disclosure describe door panels. The door panels may be particularly residential entryway door panels. As used herein, residential door panels are typically operated by a knob or lever hardware and not a horizontal push bar, which are typical in emergency doors or fire doors used in commercial or industrial settings. Residential door panels are not exclusively limited to homes. Entryway door panels may be mounted for hinged movement or sliding movement.

As used herein, an exterior of a door panel includes the visible surfaces thereof. By contrast an interior of the door panel relates to the internal portions inward of the periphery of the door panel.

As used herein, the term "longitudinal" is used to reference the longest dimension. For example, a stile of a door is known in the art as a vertical edge component of a door panel, and a longitudinal surface thereof would be a surface that runs along the height direction of the stile.

Figure 1:
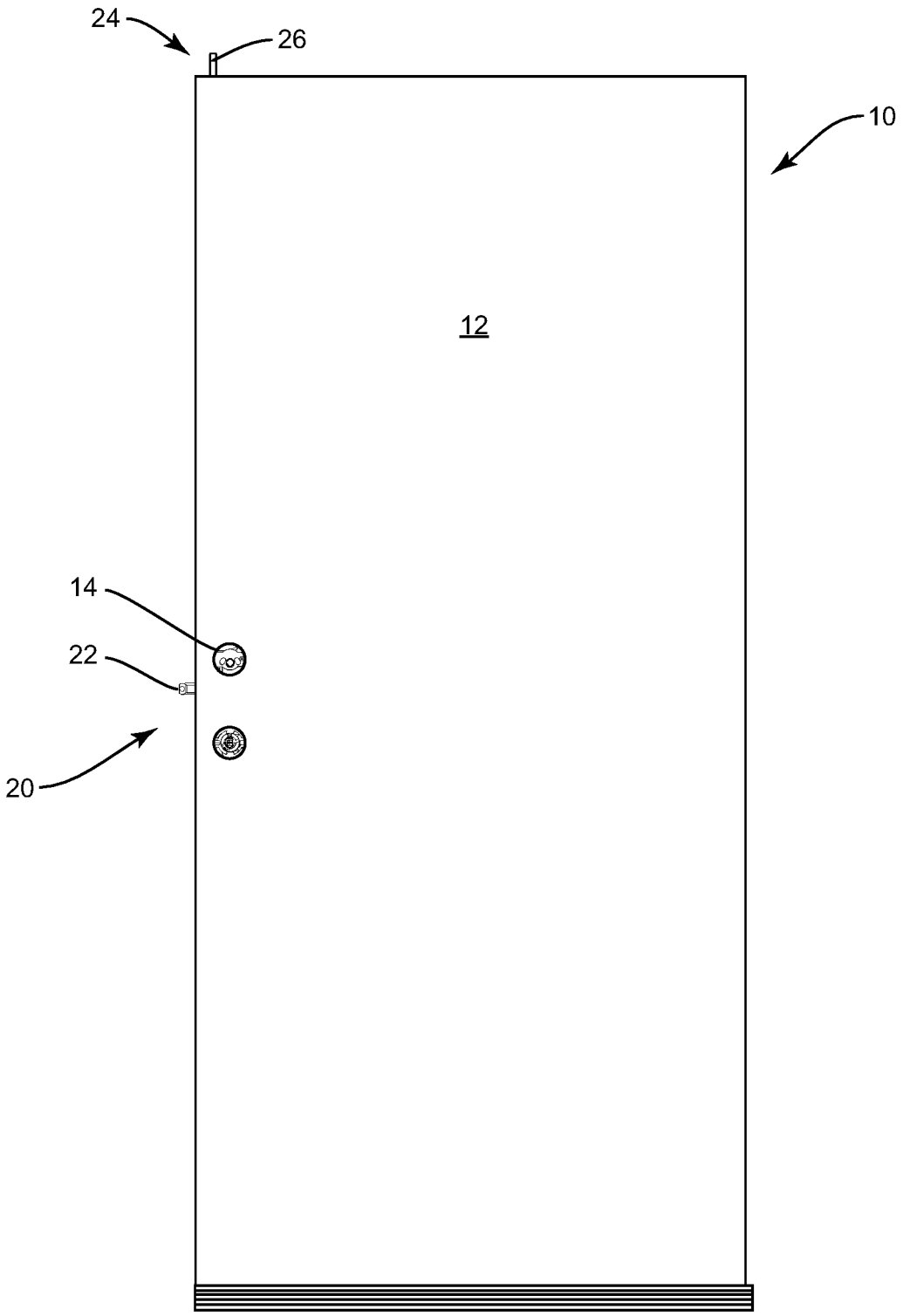
FIG. 1 shows a door panel according to one embodiment of the present disclosure.

FIG. 1 shows a door panel 10 according to an embodiment of the present disclosure. The door panel 10 includes a skin 12 for forming a face of the door panel. The skin 12 may be a metal, such as steel, or may be fiberglass or other composite material known in the art to be suitable for door panel construction. As understood by one of ordinary skill in the art, the door panel 10 may include a pair of skins 12, one skin forming each major face of the door panel. Holes 14 may be formed through the skins 12 to provide access to an interior of the door panel 10 for handle levers and other hardware. The door panel 10 of FIG. 1 is shown with a multipoint lock 20. The illustrated multipoint lock 20 includes a main latch 22 and at least one auxiliary latch 24. In the illustrated embodiment, the auxiliary latch 24 includes a shoot bolt 26 configured to extend from a top edge 37 of the door panel 10. Although not shown, an auxiliary latch may also be provided to extend from a bottom edge 39 of the door panel 10. In another embodiment, the auxiliary latch 24 is additionally or alternatively are located on the exterior longitudinal surface of a latch stile. An auxiliary latch that is configured to extend from the exterior longitudinal surface of the latch stile maybe positioned closer to the top or bottom edge of the door panel 10 than to the main latch 22.

Figure 2:
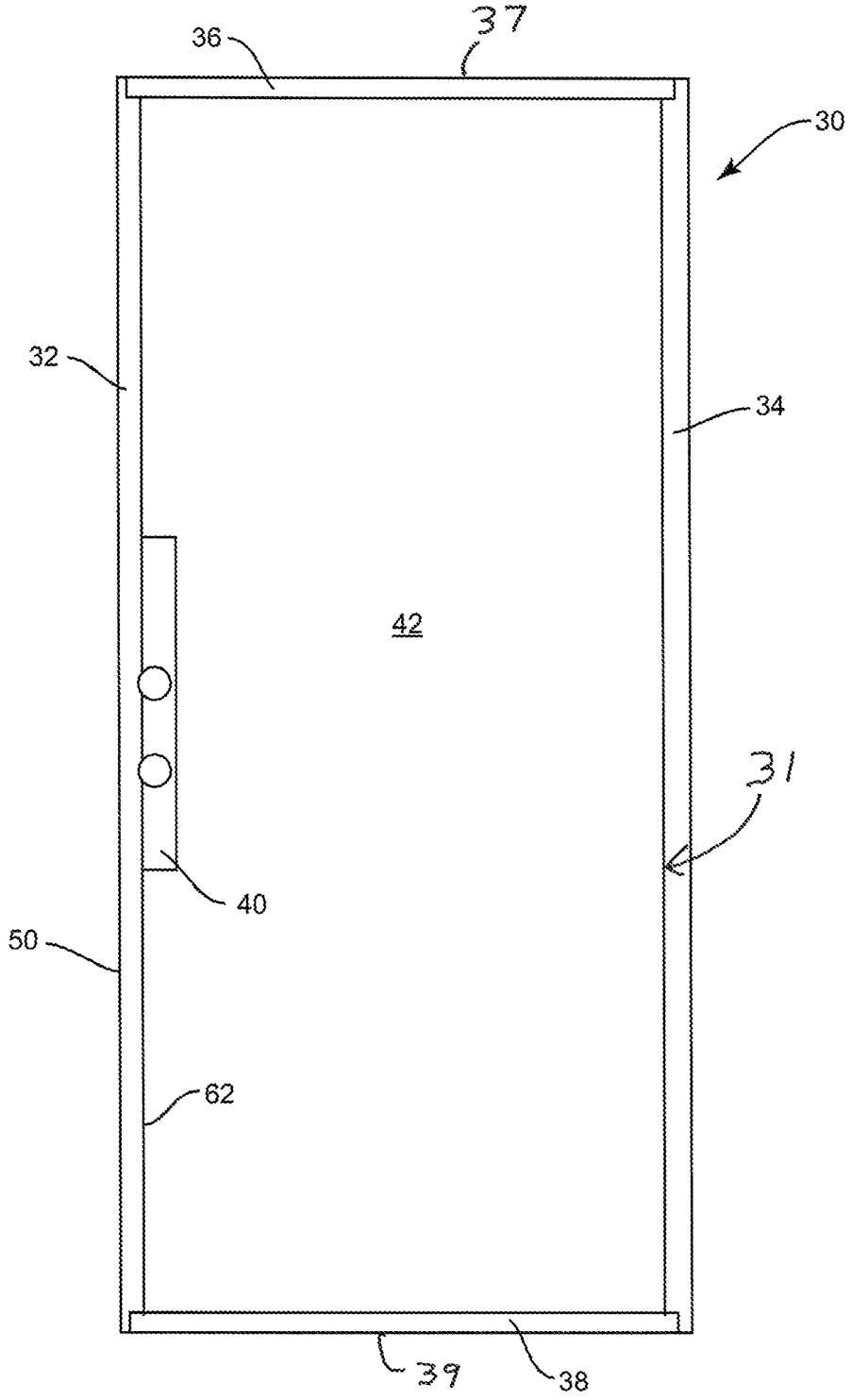
FIG. 2 shows a frame of the door panel of FIG. 1 according to one embodiment of the present disclosure.

FIG. 2 shows the door panel 10 with the skins and the multipoint lock omitted. Therefore, FIG. 2 shows a frame 30 formed from a first or latch stile 32, a second or hinge stile 34, a top rail 36, and a bottom rail 38. The hinge stile 34, as used herein, does not necessarily support hinges, such as embodiments where the door panel 10 is a sliding door. An optional lock block 40 may be provided to create a housing for a portion of the multipoint lock and to reinforce the door panel at the lock location. The top rail 36 can connect the latch stile 32 to the hinge stile 34, and the bottom rail 38 can also connect the latch stile 32 to the hinge stile 34. An insulating material 42 may at least partially fill the interior 31 of the frame 30. The insulating material 42 may be an expandable foam that can be injected through the bottom rail 38 as a liquid or semisolid when the skins 12 (FIG. 1) are in place, to at least partially fill the interior 31 of the frame 30 and provide at least one of structural support, thermal insulation, and an increased sound barrier.

Figure 3:
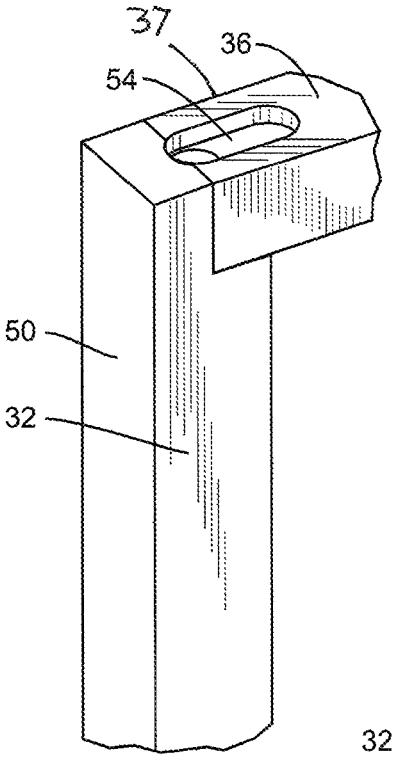
FIG. 3 is a detailed exterior view of the joint between the latch stile and the top rail according to one embodiment.

FIG. 3 shows a detailed view of a joint formed by the latch stile 32 and the top rail 36. The upper exterior view of FIG. 3 shows an exterior longitudinal surface 50 of the latch stile 32. A pocket 54 is optionally formed in a top surface of the top rail 36, where at least a portion of the pocket 54 extends completely through the top rail 36.

Figure 4:
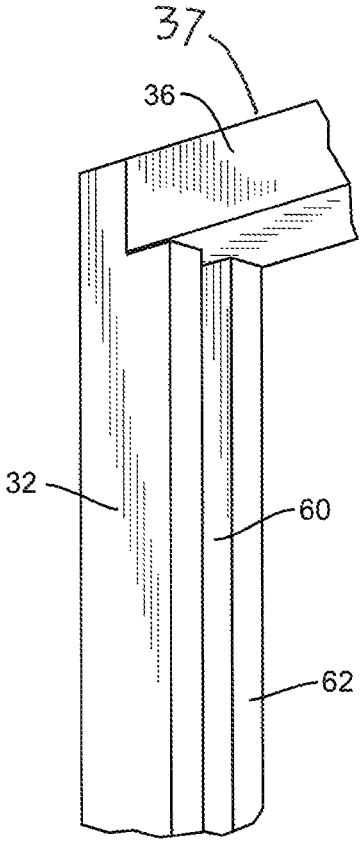
FIG. 4 is a detailed interior view of the joint between the latch stile and the top rail according to one embodiment.

FIG. 4 shows a detailed view of the joint formed by the latch stile 32 and the top rail 36 from an interior perspective. From the interior perspective, a channel 60 that is formed in, and open to, an interior longitudinal surface 62 of the latch stile 32 can be seen. The channel 60 may be in communication with the pocket 54 that passes through the top rail 36. The channel 60 may extend substantially the entire height of the latch stile 32. The channel 60 may have a constant cross section, or the cross section may vary at different positions along the height of the latch stile 32.

The channel 60 is configured to at least partially receive the multipoint lock 20 (FIG. 1). In particular, one or more drive rods 70 (FIG. 9) of the multipoint lock 20 may be positioned in and capable of sliding along the channel 60. The shoot bolt 26 may be attached to a distal end of the drive rod 70.

Figure 5:
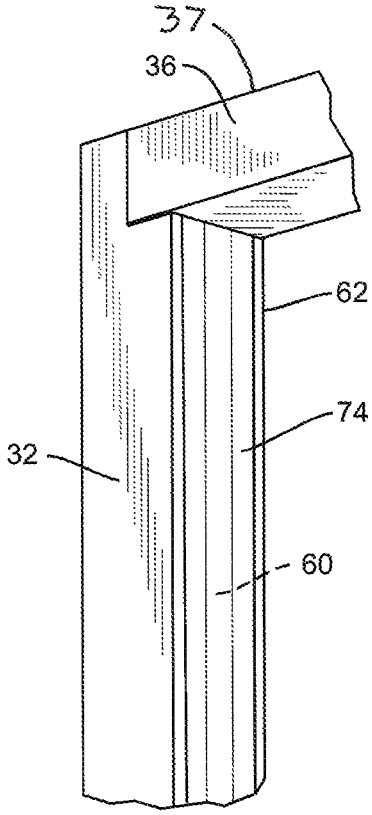
FIG. 5 is a detailed interior view of the joint between the latch stile and the top rail with a cover attached.

As shown in FIG. 5, to prevent the insulating material 42 (FIG. 2) from filling in the channel 60 when the insulating material is injected into the interior of the door panel 10, which would result in blocking movement of the drive rods 70, a cover 74 is attached to the interior longitudinal surface 62 of the latch stile 32 to block foam migration into the channel The cover 70 may be a planar sheet material formed from wood, metal, polymer, or a composite. One side of the cover 70 may be provided with projecting elements (not shown) configured to extend into the channel 60. The projecting elements may be configured to guide the motion of the drive rods 70 by conforming the cross section of the channel 60 to the shape of the drive rods.

Figure 6:
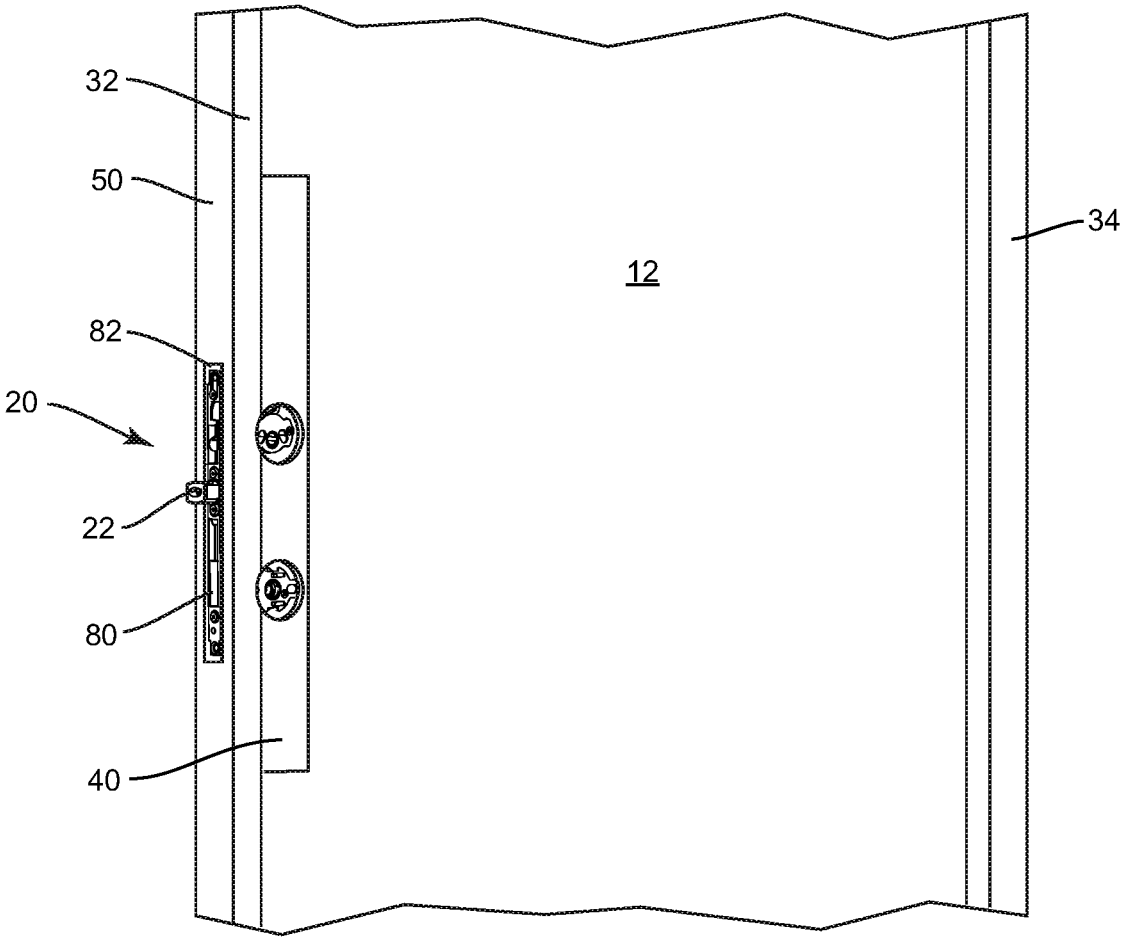
FIG. 6 shows details of the exterior of the latch stile.
Figure 7:
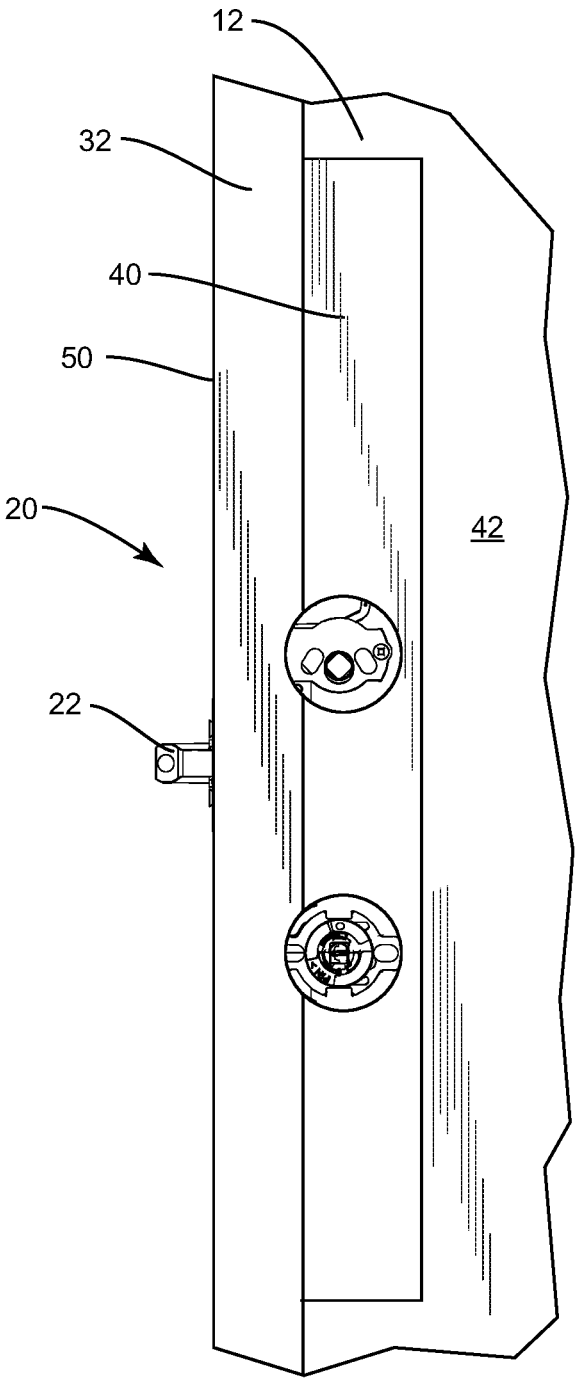
FIG. 7 shows details of the lock mortise according to one embodiment.
Figure 8:
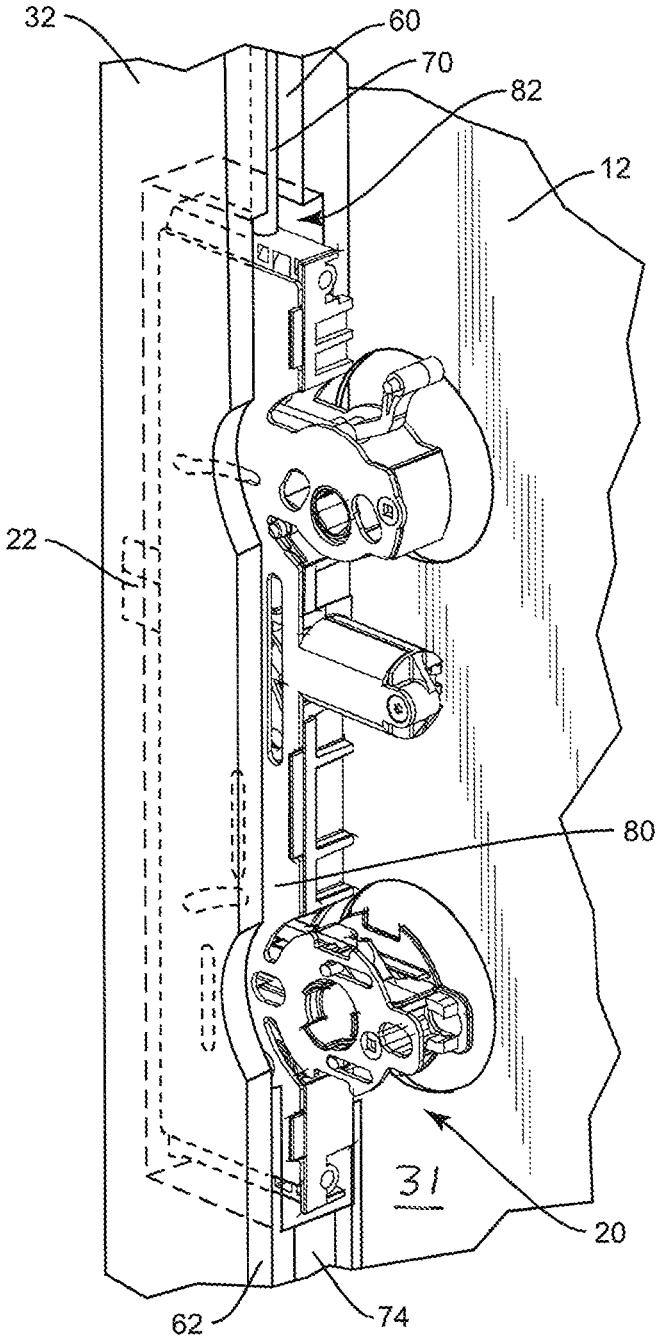
FIG. 8 shows additional details of the lock mortise according to one embodiment.

Turning to FIGS. 6-8, an arrangement of a mortise box 80 of the multipoint lock 20 relative to the latch stile 32 is shown. In one embodiment, the mortise box 80 may be attached to the door panel 10 by being inserted from the exterior longitudinal surface 50 of the latch stile 32 through an aperture 82 that is created in the latch stile. The drive rod 70 may be inserted into the channel 60 through the pocket 54 (FIG. 3). This arrangement allows for the drive rod 70 and the mortise box 80 to be connected together once inserted into the door panel 10. In another embodiment, the mortise box 80 may be inserted into the aperture 82 of the latch stile 32 from the interior longitudinal surface 62 thereof The drive rod 70 may be pre-attached to the mortise box 80 so that the drive rod 70 is inserted into the channel 60 at the same time that the mortise box is inserted into the aperture 82. Then, the top rail 36 may be attached to the latch stile 32 by dropping down the top rail such that the shoot bolt 26 is passed through the pocket 54.

Figure 9:
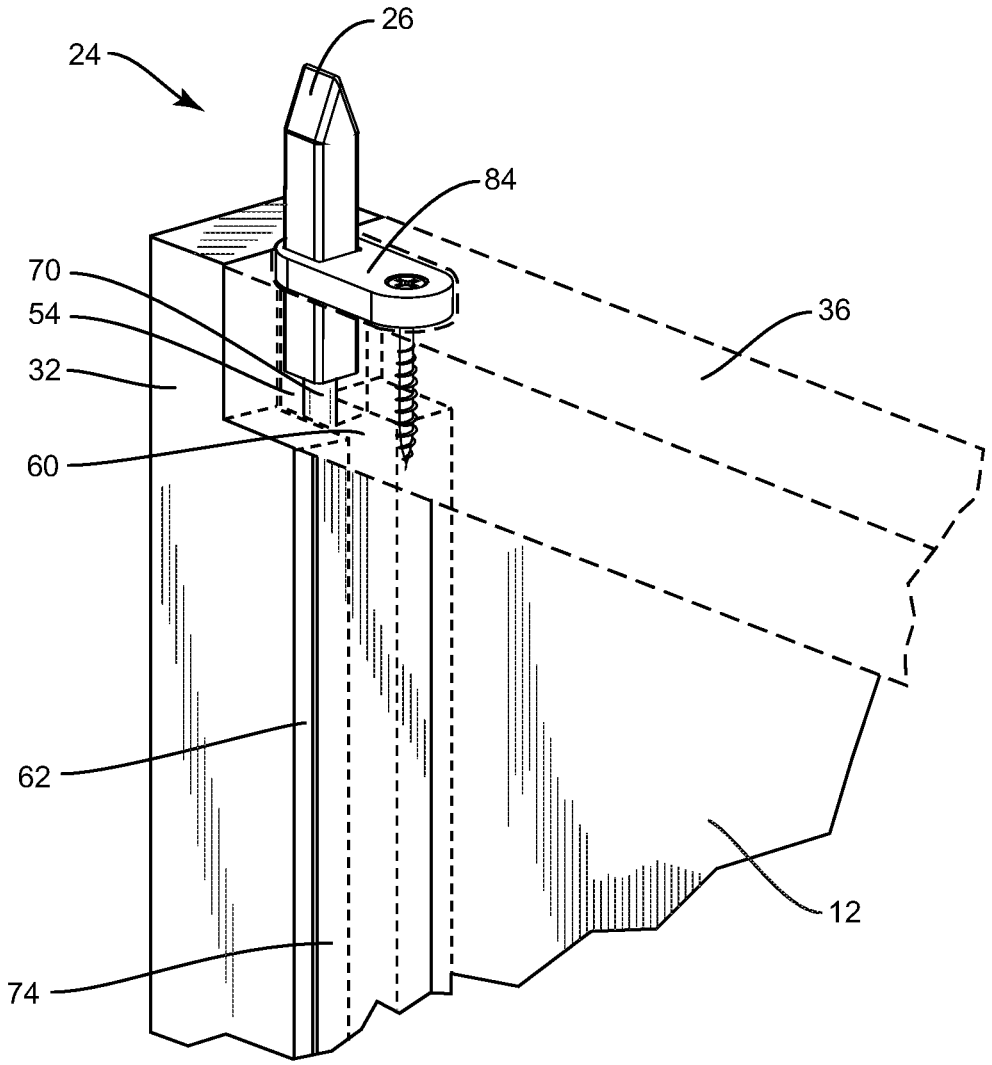
FIG. 9 shows details of a shoot bolt according to one embodiment.

FIG. 9 shows the arrangement of the auxiliary latch 24 relative to the top rail 36 according to one embodiment. The auxiliary latch 24 includes the shoot bolt 26 that attaches to the drive rod 70. A guide plate 84 may be mounted in the pocket 54 to support motion of the shoot bolt 26.

Having described the structure of the door panel 10 according to several embodiments of the present disclosure, a method of forming the door panel 10 can be understood. Unless expressly indicated, the steps of the method of forming the door panel 10 may be performed in various sequences without detracting from the scope of this disclosure. The method of forming the door panel 10 may begin by acquiring some or all of the component parts of the door panel 10, including the latch stile 32, the hinge stile 34, the top rail 36, the bottom rail 38, and the skins 12.

The channel 60 may be provided as part of the latch stile 32 upon acquisition thereof, or may be cut, machined, formed, molded, or otherwise created along one longitudinal surface of the latch stile after the latch stile is acquired. The channel 60 is preferably a part of the latch stile 32 before the latch stile is attached to the skins 12, and is most preferably a part of the latch stile 32 before the interior of the frame 30 is at least partially filled with the insulating material 42.

Before or after attaching the top rail 36 and the bottom rail 38 to the latch stile 32, the pocket 54 can be drilled, machined, or otherwise formed into at least one of the top and bottom rails at locations which will align with and communicate with the channel 60 in the latch stile.

The frame 30 of the door panel 10 can be created by joining together the latch stile 32, the hinge stile 34, the top rail 36, and the bottom rail 38 with the longitudinal surface of the latch stile that includes the channel 60 arranged to face the hinged stile, and therefore the channel faces toward the interior of the door panel.

The cover 74 may be attached to the interior longitudinal surface 62 of the latch stile 32 to seal at least a portion of the channel 60 either before or after the latch stile is made part of the frame 30. Again, the cover 74 is used to substantially prevent the insulating material 42 from entering the channel 60.

The drive rod 70 may be at least partially positioned within the channel 60 before the cover 74 is attached or after the cover is attached. If inserted through a pocket 54, the drive rod 70 may be positioned at least partially within the channel 60 after one or both of the skins 12 have been added to the frame 30, and even after the insulating material 42 has at least partially filled the interior of the door panel 10. Before or after the drive rod 70 is positioned within the channel 60, the shoot bolt 26 may be attached to the distal end of the drive rod.

The aperture 82 in the exterior longitudinal surface 50 of the latch stile 32 may be created before or after the latch stile is acquired, and may be created before or after the interior of the door panel 10 has been at least partially filled with the insulating material 42. The aperture 82 is, however, configured to communicate with the channel 60.

The mortise box 80 of the multipoint lock 20 may be added to the door panel 10 by being at least partially positioned within the aperture 82 before or after the insulating material 42 has been injected to at least partially fill the interior of the door panel.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

The invention claimed is:

1. A door panel for use in a residential entryway, the door panel comprising:

a frame, comprising:

a first stile including an interior longitudinal surface;

a second stile, the interior longitudinal surface of the first stile facing the second stile;

a top rail connecting the first stile to the second stile; and a bottom rail connecting the first stile to the second stile; and a pair of opposing skins on respective faces of the frame, wherein the first stile includes a channel defined in the interior longitudinal surface of the first stile, the channel extending from the top rail to the bottom rail, wherein a cover is attached to the interior longitudinal surface of the first stile to at least partially seal the channel.

2. The door panel of claim 1, further comprising a multipoint lock at least partially installed in the channel.

3. The door panel of claim 2, wherein the first stile comprises an aperture on an exterior longitudinal surface thereof, and the multipoint lock comprises a mortise box at least partially positioned in the aperture.

4. The door panel of claim 2, wherein the multipoint lock includes at least one drive rod positioned along and slidable relative to the channel.

5. The door panel of claim 4, wherein the drive rod is attached to a shoot bolt configured to extend and retract relative to one of a top edge and a bottom edge of the door panel.

6. The door panel of claim 4, wherein the drive rod is attached to an auxiliary latch located on and extendable from an exterior longitudinal surface of the first stile.

7. A method of forming a door panel comprising a multipoint lock, the method comprising:

acquiring a first stile, a second stile, a top rail, and a bottom rail suitable for forming a frame of the door panel;

creating a channel in a longitudinal surface of the first stile;

at least partially positioning the multipoint lock within the channel;

attaching a cover to the longitudinal surface to seal at least a portion of the channel;

joining the first stile, the second stile, the top rail, and the bottom rail to form the frame with the channel facing the second stile;

joining a pair of skins to the frame; and at least partially filling an interior of the frame with an insulating material after the skins are joined to the frame, wherein the cover substantially prevents the insulating material from entering the channel.

8. The method of claim 7 further comprising:

creating an aperture on an opposite longitudinal surface of the first stile in communication with the channel, and positioning a mortise box of the multipoint lock at least partially in the aperture.

9. The method of claim 7, wherein the step of at least partially positioning the multipoint lock within the channel comprises positioning at least one drive rod along the channel.

10. The method of claim 9, further comprising attaching a shoot bolt to a distal end of the at least one drive rod.

11. A door panel for use in a residential entryway, the door panel comprising:

a frame, comprising:

a first stile including an interior longitudinal surface and a channel defined in the interior longitudinal surface;

a second stile, the interior longitudinal surface of the first stile facing the second stile;

a top rail connecting the first stile to the second stile; and a bottom rail connecting the first stile to the second stile;

a pair of opposing skins on respective faces of the frame;

a multipoint lock at least partially installed in the channel; and a cover attached to the interior longitudinal surface of the first stile to at least partially seal the channel.

12. The door panel of claim 11, wherein the first stile comprises an aperture on an exterior longitudinal surface thereof, and the multipoint lock comprises a mortise box at least partially positioned in the aperture.

13. The door panel of claim 11, wherein the multipoint lock includes at least one drive rod positioned along and slidable relative to the channel.

14. The door panel of claim 13, wherein the drive rod is attached to a shoot bolt configured to extend and retract relative to one of a top edge and a bottom edge of the door panel.

15. The door panel of claim 13, wherein the drive rod is attached to an auxiliary latch located on and extendable from an exterior longitudinal surface of the first stile.

* * * * *